United States Patent [19]

Frank

[11] Patent Number: 4,756,434

[45] Date of Patent: Jul. 12, 1988

[54] TAMPER PROOF CAP

[76] Inventor: Edward G. Frank, 3510-A Wimberly La., Winston-Salem, N.C. 27106

[21] Appl. No.: 123,769

[22] Filed: Nov. 23, 1987

[51] Int. Cl.[4] ..... A61J 1/00; B65D 55/02; B65D 85/56

[52] U.S. Cl. ..... 215/201; 220/253; 206/528; 206/540

[58] Field of Search ..... 215/201, 206; 206/1.5, 206/528, 540; 220/253; 222/513

[56] References Cited

U.S. PATENT DOCUMENTS

| | | | |
|---|---|---|---|
| 4,141,461 | 2/1979 | La Chance | 215/201 |
| 4,353,473 | 10/1982 | Morris | 215/206 |
| 4,544,063 | 10/1985 | Neward | 220/253 |
| 4,572,376 | 2/1986 | Wrennall | 220/253 |

*Primary Examiner*—George T. Hall
*Attorney, Agent, or Firm*—Leon Gilden

[57] ABSTRACT

A tamper proof cap is set forth including a base for interconnection to a container of pills or the like to be dispensed. An intermediate portion is rotatably mounted between said base and an upper portion said upper portion is keyed for a non-rotating interfitting relationship with respect to said base portion. An integrally formed downwardly projecting tab formed to said upper portion is positioned within a circular groove formed within said intermediate portion. A first channel formed within said base portion communicates with a second channel on said intermediate portion to enable a capsule to be rotatably repositioned to an exit opening within said upper portion. An effort to reintroduce a capsule to said container is precluded due to said positioning of said downwardly projecting tab relative to said first channel ratcheting of said intermediate portion relative to said base portions enabling unidirectional rotation only.

7 Claims, 1 Drawing Sheet

TAMPER PROOF CAP

BACKGROUND OF THE INVENTION

1. Field of the Invention

The present invention relates to dispensing apparatus, and more particularly pertains to a new and improved tamper proof dispenser cap which prevents the introduction of a capsule or tablet-like item into the container and allows dispensing only of items from said container.

2. Description of the Prior Art

The use of tamper proof caps is well known in the prior art. As may be appreciated, these devices have normally been of relatively complex structure or of ineffective construction to prevent tampering or the reintroduction of counterfeit or deleterious materials into a medicinal dispensing container. In this connection, there have been several attempts to develop tamper proof caps preventing the introduction of hazardous or unwanted items within a dispensing container and particularly one associated with the dispensing of drugs. For example, U.S. Pat. No. 3,759,420 to Karkanen sets forth a two-part cap with a rotatable portion relatively rotatable to a stationary base wherein a series of subsequent steps are required to extract a pill thereby by thwarting efforts of a child or adult from dispensing medicine from the associated container. Dispensing of the pill is associated to a rotating of the container whereby the joint cooperation of these steps enables withdrawal of the pill from the container. There is provided no positive means for preventing introduction of pills to a container utilizing the closure.

U.S. Pat. No. 3,874,564 to Huneke is another similar patent as the above wherein a plural rotation of a container in cooperation with a multi-part cap enables subsequent withdrawal of a single capsule therefrom. Proper cap sequencing in combination with container inversion enables the cap from preventing plural or unwanted medicinal withdrawal from an associated container.

U.S. Pat. No. 4,460,106 to Moulding et al, utilizes a dispensing container of multi-part construction wherein electrical contact switches may be associated with the compartments to enable sensing of pill movement therethrough. Essentially sequential advancement of pills from one compartment to another enables the desired withdrawal from the associated container.

U.S. Pat. No. 4,523,694 to Veltri prevents the dispensing cap for medication containers wherein a single dosage is dispensed by means of an inner stationary cap associated rotatably with an outer cap enabling a single pill or capsule to be presented through a discharge port. The container is designed essentially to prevent children and the like from obtaining pills or other medication from within the confines of the container. The safety of the cap relies on relative relationships of the various parts thereof to enable dispensing therethrough but as in the other prior art references fails to provide a comparable three-part cap of the instant invention enabling a single capsule to be removed yet not reintroduced within the confines of the container.

German Pat. No. DE 3,048,865 A1 to Schonfeld illustrates a dispenser utilizing a cylindrical cap with a transverse opening for a discharge wall which permits tablets to leave and enter the rotating cap when rotated to an appropriate position but fails to confront the problem of avoiding reintroduction of harmful or undesirable substances into a medicine container.

As such, it may be appreciated that there is a continuing need for a new and improved medicinal dispensing cap which addresses both the problem of dispensing and prevention of introduction of undesirable or harmful substance to within the container and in this respect, the present substantially fulfills this need.

SUMMARY OF THE INVENTION

In view of the foregoing disadvantages inherent in the known types of tamper proof caps now present in the prior art, the present invention provides a tamper proof cap wherein a three-part cap enables a central receiving rotatable portion to transport a tablet or capsule-like element to a discharge port while preventing the entry of a capsule or tablet to within the confines of the container. As such, the general purpose of the present invention, which will be described subsequently in greater detail, is to provide a new and improved tamper proof cap which has all the advantages of the prior art tamper proof caps and none of the disadvantages.

To attain this, the present invention comprises a tamper proof cap wherein a stationary bottom portion and top portion are relatively rotatably associated with a central portion that enables conveyance of a tablet or capsule-like element to be deposit to within a channel therein from within the lower stationary portion and transported to a discharge port located within a top stationary portion of the cap. The top stationary portion of the cap includes a blocking element preventing the re-entry of capsules or tablets or the like to within the container.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tamper proof cap which has all the advantages of the prior art tamper proof caps and none of the disadvantages.

It is another object of the present invention to provide a new and improved tamper proof cap which may be easily and efficiently manufactured and marketed.

It is a further object of the present invention to provide a new and improved tamper proof cap which is of a durable and reliable construction.

An even further object of the present invention is to provide a new and improved tamper proof cap which is susceptible of a low cost of manufacture with regard to both materials and labor, and which accordingly is then susceptible of low prices of sale to the consuming public, thereby making such tamper proof caps economically available to the buying public.

Still yet another object of the present invention is to provide a new and improved tamper proof cap which provides in the apparatuses and methods of the prior art some of the advantages thereof, while simultaneously overcoming some of the disadvantages normally associated therewith.

Still another object of the present invention is to provide a new and improved tamper proof cap wherein a lower stationary base portion has formed therethrough a channel to deliver a tablet-like element to a centrally rotatable transporting member.

Even still another object of the present invention is to provide a new and improved tamper proof cap wherein a central rotating portion may deliver a tablet or capsule-like element to a discharge port located within an overlying stationary portion.

Yet another object of the present invention is to provide a new and improved tamper proof cap wherein a three-part cap utilizes a blocker tab located on an upper stationary portion to prevent the entry of tablets or capsule-like elements to within the confines of a dispensing container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
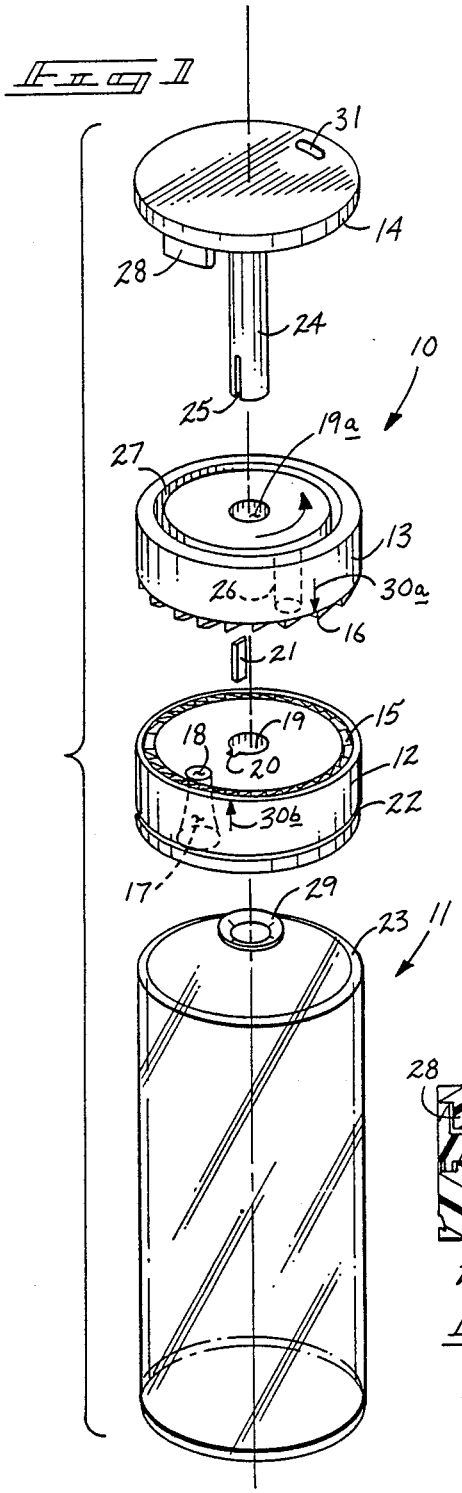
FIG. 1 is an isometric illustration of the present invention illustrating in an exploded view the various components, their configurations, and relationship.

With reference now to the drawings, and in particular to FIG. 1 thereof, a new and improved tamper proof cap embodying the principles and concepts of the present invention and generally designated by the reference numeral 10 will be described.

More specifically, it will be noted that the tamper proof cap 10 is engagingly associated with a medicinal container 11. A lower portion 12 is secured to container 11 by means of a receiving groove 22 engagingly receiving a container locking lip 23 for secure association of the two members. Alternative fastening arrangements may be used, such as interrupted threads, etc., but the primary purpose is to provide a secure interengaging relationship between the lower portion 12 and container 11.

Figure 5:
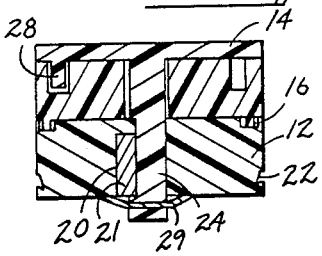
FIG. 5 is an orthographic side view taken along the lines 5—5 of FIG. 2 in the direction indicated by the arrows.
Figure 4:
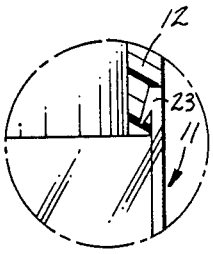
FIG. 4 is an orthographic expanded view of the portion designated in FIG. 2.

A central rotatable portion 13 is rotatably mounted relative to lower portion 12 and an upper portion 14. Lower ratchet teeth 15 integrally associated with lower portion 12 operatively engage upper ratchet teeth 16 for a one-way rotatable mounting of central portion 14 relative to lower portion 12 and an upper portion 14. An exit port 17 formed within lower stationary portion 12 is configured to accept a pre-selected number of tablets, pills or the like of medicine and transport them to an exit port opening 18 at an upper surface of lower portion 12. A central bore 19 is formed within lower portion 12 through a center thereof and is aligned with a companion bore **19*a* formed within central rotatable portion 13. A keyhole slot 20 is formed in lower portion 12 depending from central bore 19 and is configured to accept a key 21 located within a key slot 25 formed within stem 24 of upper portion 14 to fix upper portion 14 and lower portion 12 non-rotatably relative to each other. Securing of stem 24 to the under surface of lower portion 12, as illustrated in FIG. 5, includes a resilient angular lock spring 29 to join portions 12, 13 and 14 together essentially as illustrated. Lock spring 29 enables limited reciprocal motion of stem 24 to the extent of enabling cooperating lower and upper ratchet teeth to ride over one another for rotation of central portion 13 relative to fixed upper and lower portion 12 and 14** in a one-way counter-clockwise relationship, as illustrated.

Figure 2:
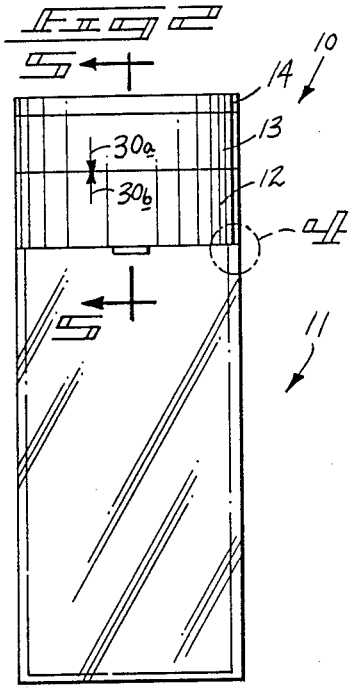
FIG. 2 is an orthographic view in elevation of the present invention illustrating the assembled cap on an associated container.
Figure 3:
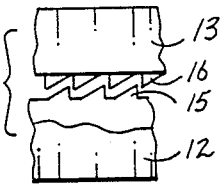
FIG. 3 is an orthographic view in elevation on an enlarged scale of the one-way ratcheting mechanism utilized by the instant invention.

Formed within central portion 13 is a transport conduit 26 that upon container 11 being inverted, permits a pill or capsule-like element to be delivered through exit port 17 from said container to a transport conduit 26 upon aligning indicating arrows **30*a* and 30*b*, essentially as illustrated in FIG. 2. While still inverted, central portion 13 is rotated counter-clockwise to deliver the aforenoted medicine to a discharge port 31**.

A downwardly extending blocker tab 28 integrally secured to upper portion 14 rides within block groove 27 formed within central portion 13 whereby the attempted introduction of an undesirable substance through discharge port 13 will be prevented from entering container by means of blocker tab 28 positioned forwardly in the path of travel of exit port 17, as illustrated in FIG. 1.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A tamper proof cap assembly for securement to a like opening in a container for the dispensing of medicinal elements and prevention of introduction of undesirable elements to said container wherein said cap assembly comprises, a lower annular portion facedly secured into said container and fixedly securing an upper portion a spaced distance relative to said lower portion, and a central portion rotatably mounted relative to said upper and lower portions within said spaced distance, and an exit port in said lower portion in communication with said container positioned to deliver a medicinal element to a transport conduit in said central portion, and a discharge port in said upper portion to discharge a medicinal element from said cap assembly, and a blocking means secured to said upper portion and cooperating with said central portion for preventing the introduction of elements into said container via said exit port, transport conduit, or discharge port.

2. A tamper proof cap assembly as set forth in claim 1 wherein said central portion is rotatably mounted in one direction only relative to said upper and lower portions.

3. A tamper proof cap assembly as set forth in claim 2 wherein cooperating ratchet teeth formed on said lower and central portions enable unidirectional rotation of said central portion relative to said upper and lower portions.

4. A tamper proof cap assembly as set forth in claim 3 wherein said blocking means includes a blocking tab integrally formed to said upper portion and extending downwardly therefrom in a fixed orientation relative to said lower portion adjacent said exit port upstream of said direction of rotation of said central portion relative to said upper and lower portions.

5. A tamper proof cap assembly as set forth in claim 1 wherein said upper portion is unrotatably mounted relative to said lower portion by means of a key secured to said upper portion mountable in a key slot in said lower portion.

6. A tamper proof cap assembly as set forth in claim 1 wherein said locking means rides in a complementary formed groove formed in said central portion.

7. A tamper proof cap assembly as set forth in claim 1 wherein a resilient spring-like securing means secures said upper portion to said lower portion and enables relative motion of said upper portion to said lower portion a distance substantially equal to the height of a ratchet tooth utilized in a complementary array of ratchet teeth formed on respective lower and central portions.

* * * * *